US006145223A

United States Patent [19]

Flesen

[11] Patent Number: 6,145,223

[45] Date of Patent: Nov. 14, 2000

[54] DREDGING APPARATUS

[75] Inventor: Steinar Flesen, Hundvåg, Norway

[73] Assignee: AGR Ability Group AS, Sandsli, Norway

[21] Appl. No.: 09/254,979

[22] PCT Filed: Sep. 11, 1997

[86] PCT No.: PCT/NO97/00245

§ 371 Date: Mar. 17, 1999

§ 102(e) Date: Mar. 17, 1999

[87] PCT Pub. No.: WO98/12390

PCT Pub. Date: Mar. 26, 1998

[30] Foreign Application Priority Data

Sep. 18, 1996 [NO] Norway ..... 963897

[51] Int. Cl.[7] ..... E02F 3/88

[52] U.S. Cl. ..... 37/317; 299/8

[58] Field of Search ..... 37/317, 318, 322, 37/323; 299/8; 417/174, 78, 84, 178, 183

[56] References Cited

U.S. PATENT DOCUMENTS

| | | | |
|---|---|---|---|
| 3,010,232 | 11/1961 | Skakel et al. | 37/317 |
| 3,248,812 | 5/1966 | Gardner, Jr. | 37/323 |
| 3,646,694 | 3/1972 | Beck, Jr. | 37/317 |
| 3,774,323 | 11/1973 | Vaughn | 37/322 |
| 4,070,061 | 1/1978 | Obolensky | 299/8 |
| 4,165,571 | 8/1979 | Chang et al. . | |
| 4,207,690 | 6/1980 | Niskala | 37/317 |
| 4,391,468 | 7/1983 | Funk | 299/8 |
| 4,681,372 | 7/1987 | McClure . | |

FOREIGN PATENT DOCUMENTS

| | | |
|---|---|---|
| 140995 | 12/1979 | Norway . |
| 7413955 | 7/1981 | Sweden . |
| 2 242 698 | 10/1991 | United Kingdom . |

*Primary Examiner*—Robert E. Pezzuto
*Attorney, Agent, or Firm*—Foley & Lardner

[57] ABSTRACT

A dredging apparatus for the removal of cuttings gathered around a bore hole mouth on the seabed has an ejector coupled to a suction hose and a conveyor pipe, respectively, for moving the cuttings to another place on the seabed. The dredging apparatus comprises a drive motor, a pumping device and an ejector, the drive motor being adapted to drive the pumping device which, in turn, is adapted to deliver a forced flow of water to the ejector in order to establish and maintain the ejecting effect. The ejector, pumping device and drive motor are assembled to form a unit. A cable delivers energy to the motor from the surface.

6 Claims, 2 Drawing Sheets

DREDGING APPARATUS

Figure 1:
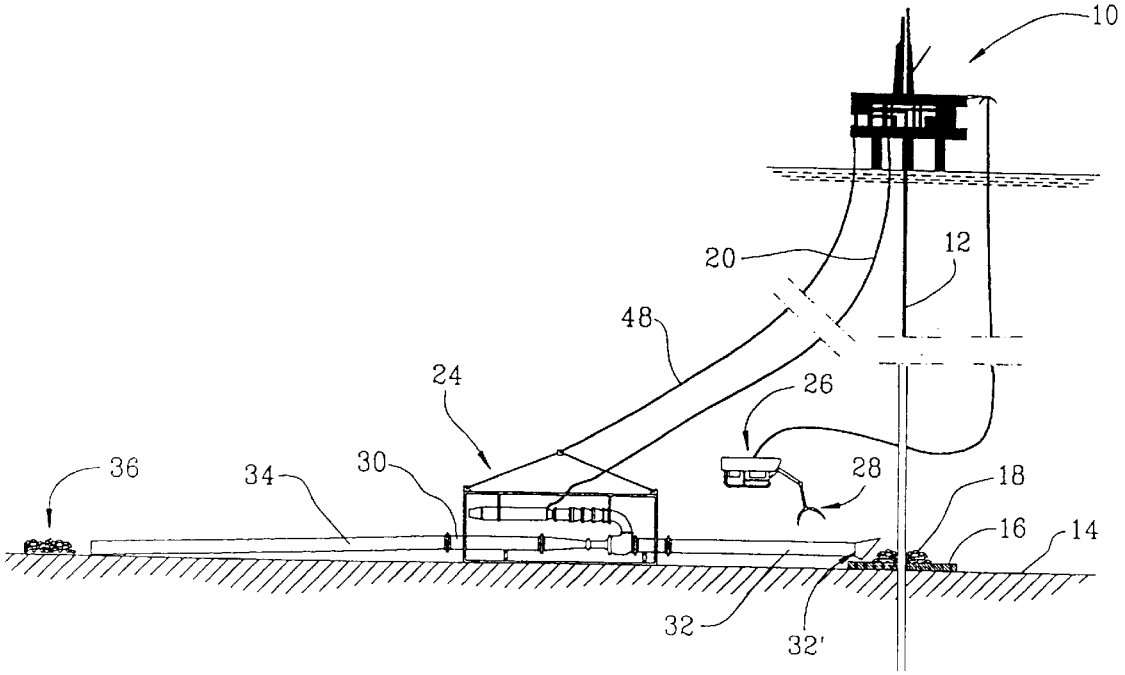

The present invention relates to a dredging apparatus, particularly intended for the removal of cuttings at the seabed around bore holes, said apparatus comprising a suction hose assigned a driven ejector which, at the ejecting aperture thereof, is coupled to an elongate pipe wherethrough cuttings sucked in through the intake opening of the suction hose are conveyed, said cuttings being conveyed through the suction hose to the ejecting aperture of the ejector, where said elongate pipe takes over the cuttings transport, feeding the cuttings out through the discharge aperture thereof situated at a substantial distance from the intake opening of the suction hose.

According to known technique, the ejector acting as the water flow based conveyor of the dredging apparatus, is driven by a motor-operated pumping device. When carrying out dredging and similar operations on the seabed, said pump is, according to known technique, mounted on the platfrom deck and, from the pump, a coarse-dimensioned hose extends down to the ejector on the seabed. At sea depths of e.g. 150 meters or more, operations must be carried out using a substantial pumping pressure at platform deck level, because one has to expect significant pressure losses within the hose/pipe system down to the ejector.

According to prior art technique, water to the motor-driven water pump is first pumped up to the platform deck and, thereafter, downwards again within the e.g. 150 meters long pipeline. Through the pipeline, e.g. 300–400 $m^3$ water per hour may be conveyed. Thus, the part of a known dredging apparatus which is mounted on the deck constitutes a disproportionately large, bulky and heavy equipment package.

The ejector of the dredging apparatus working on the seabed is, preferably, assisted by a remote control vehicle (RCV) which may be adapted to guide the intake opening of the suction hose in order to hold it in a correctly positioned and orientated position in relation to the heap of cuttings.

The main object of the present invention has been to provide a space and weight saving dredging apparatus of the kind defined introductorily, in which also substantial energy savings are achieved.

According to the invention, this main object is realized by means of a dredging apparatus designed, shaped and adapted in accordance with the characterizing clause of the following claim 1.

In accordance with the present invention, the ejector and its water pump with drive motor are built together to a unit lowerable down to the seabed, where to the intake end of the ejector, as known per se, is coupled a suction hose/pipe for sucking in cuttings, mud, etc., desired to be removed from a certain, first place on the seabed, e.g. around the upper mouth of a bore hole, and where to the pressure end of the ejector, as known per se, is coupled a carrying off pipeline for the transfer of sucked-in cuttings, mud, etc., to another place on the seabed, well spaced from said first place, power (electricity/hydraulic pressure) to the drive motor of the water pump being delivered through a cable/hose from the surface/platform.

Through an arrangement according to the invention, significant weight savings are achieved, neither pump aggregate nor water hose drum being needed on the platfrom deck. Also, the arrangement will result in very significant energy savings due to the very much reduced pumping length for the drive water.

Figure 2:
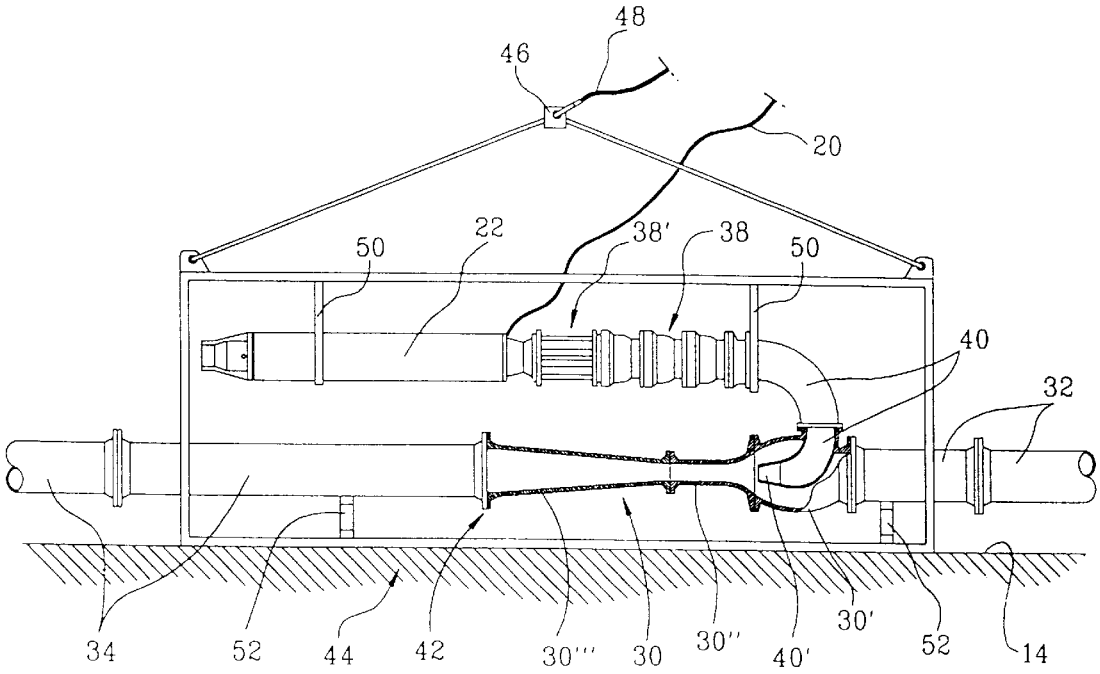

A dredging apparatus having an associated lowering and power supplying cable according to the invention is further explained in the following, reference being made to a non-restricting examplary embodiment diagrammatically illustrated in the accompanying drawings, in which:

FIG. 1 is a situational view showing the positioning of a dredging apparatus according to the invention on the seabed, said dredging apparatus having a hoisting wire and electrical cable connection to a drilling rig which has been shown on a substantially smaller scale than the dredging apparatus, and where the dredging by means of the ejector-operated dredging apparatus is assisted by a RCV of an embodiment known per se and adapted to keep the intake opening of the suction hose correctly positioned in relation to a heap of cuttings around a bore hole mouth;

FIG. 2 shows a detailed view of the dredging apparatus in a side elevational view and on a significantly larger scale than in FIG. 1, cut through in a portion where a pipe bend having a narrowed outlet, from the pumping section of the dredging apparatus is passed down into the ejector's pressure portion, which widens itself conically in the flowing direction of the "mud", and to which is connected the upstream sucking portion of the ejector, said bend from the pumping section constituting a part of the ejector, which directs an axially extending water jet moving with a large speed towards the outlet opening of the connected pipe, so that a suction effect is established in the connected hose, upstream of the outlet opening of the bend.

First, reference is made to FIG. 1 where, from a drilling platform having a rig 10, a drill pipe string 12 extends to a bore hole in the seabed formation 14, and where a template is indicated at 16. Around the bore hole mouth at seabed level, cuttings 18 have gathered in a heap.

The dredging apparatus according to the invention is, of course, not limited to the nature of "the mud material". Any mud-like, sand, gravel or pebble-shaped materiale desired to be removed from one place at the seabed to another place thereron, may be conveyed therebetween in accordance with the invention.

The dredging apparatus requires only the presence of an electrical generator or a hydraulic pump to deliver energy through a cable 20 extending from the platform 10 to the drive motor of the dredging apparatus. In this case, said drive motor is an electrical motor 22, FIG. 2, the dredging apparatus in general being denoted at reference numeral 24.

In FIG. 1, reference numeral 26 denotes a remote control vehicle, known per se, operating a tool 28 in the form of a grip, with which the tool 28 can catch and hold the suction hose end 32' of the dredging apparatus 24, the opposite end of the suction hose 32 is coupled to the suction end of an ejector 30, and to the pressure end of the ejector, an elongate pipe or hose 34 is coupled, the length and, thus, the outlet end thereof enabling a transfer of cuttings 18 from the area around the bore hole mouth to a discharge place 36.

In FIG. 2, the dredging apparatus 24 comprises a pumping device 38 driven by the electrical motor 22. This pumping device has water intake openings 38', and the pressure end thereof is coupled to a 180° pipe bend 40, the narrowing outlet end opening 40' thereof being passed water-tightly down through and into an upstream section 30' of the ejector's 30 flowing pipe portion, the outlet end of the pipe bend 40 being directed in the water flowing direction through the ejector, constituting a part of the same, namely its part 40 which is coupled to the water pump and which, through the pump device 38, establishes the desired ejecting effect in the form of a directional water jet flow through the tubular flow portion 30', 30" and 30'" of the ejector. To the suction end of the ejector pipe 30, at the upstream end of the section 30', a suction hose 32 is connected. The extent of the suction hose 32 is indicated in FIG. 1, the outer, free intake end thereof having a funnel-haped inlet portion 32', through which cuttings 18 are sucked in and conveyed in a direction towards the ejector 30 in the suction hose 32. At the outlet end opening 40' of the pipe bend 40, the ejector 30 takes over the transport of the cuttings 18 and delivers them at the discharge opening of the ejector 30, at the flange coupling 42, where the pipe 34 forwards the transfer of the cuttings 18 to the previously mentioned place 36 on the seabed 14, at the discharge end of the pipe 34.

The electrical motor 22 to which the electrical cable 20 is coupled, may be pressure-compensated.

The drive motor 22, pumping device 38, ejector 30,40 and, possibly, hose 32 and pipeline 34 coupled thereto of the dredging apparatus may be disposed within a frame 44 having an upper, central suspension ring 46, with which the frame 44 together with the dredging apparatus 24 may be hoisted up and lowered down by means of a wire 48 operated from the surface/the platform 10.

Suspension brackets 50 and supports 52 keep the individual components of the dredging apparat in their correct positions in relation to the frame 44 carrying the brackets, supports, etc., for the mounting of the dredging apparatus.

Contrary to the known dredging apparatus of the kind concerned, where the pumping device and the drive motor thereof are disposed on the platform deck and first have to pump water up from the surface of the sea, and where to the ejector 30,40 on the seabed extends a very elongate water pipeline, e.g. of a length of e.g. 150 meters, corresponding to the distance from the surface down to the seabed 14, the ejector 30,40 of the present invention is assembled with the water pump 38 and the drive motor 22 of the latter.

As no pressure drop occurs in the pipeline between the pumping device 38 and the ejector 30,40 of a dredging apparatus according to the invention, a pump and a drive motor each having a significantly smaller capacity than those used in prior art dredging apparatus may be used with the invention, simultaneously as the dredging apparatus releases deck space as drive motor and pumping device are positioned on the seabed together with the ejctor 30,40. Along with space savings on the drilling platform, a significant weight reduction is achieved also.

What is claimed is:

1. A dredging apparatus for performing work on a seabed, said dredging apparatus comprising:

a drive motor;

a pumping device;

an ejector having a pipe bend portion with a first end connected to an outlet of said pumping device and a second narrowed outlet end forming a nozzle and passing down and into a pressure portion of said ejector, wherein said drive motor operates the pumping device and said pumping device delivers a forced water flow to said pressure portion of said ejector to maintain an axially extending waterjet towards an outlet end of said ejector;

a suction pipe connected to an inlet end of said ejector, upstream of said pressure portion of said ejector, said suction pipe having an inlet portion for sucking in materials on the seabed, wherein said materials are sucked into said pressure portion of said ejector upstream of said axially extending waterjet;

an outlet transfer pipe connected to said outlet end of said ejector, wherein said suction pipe, said ejector pressure portion and said outlet transfer pipe form a continuous bore for transferring materials from one location on a seabed to a second location and, wherein said ejector, the pumping device, and the drive motor form an integral unit.

2. A dredging apparatus as set forth in claim 1, wherein the unit is suspended from a frame, the drive motor and the pumping device are disposed in a prolongation spatial relationship to each other at an upper level within the frame, the ejector is disposed below said drive motor and the pumping device at a lower level of the frame, wherein the pumping device, and an opposite end of the motor, are connected to an upstream end of said pipe bend portion, said pipe bend portion constituting a 180° bend, and wherein the downstream end of said pipe bend portion is positioned between said ejector pipe's suction end and said ejector outlet end, with the outlet thereof facing the ejector opening of the ejector pipe and said outlet transfer pipe, wherein the ejector has a gradually increasing pipe diameter in a direction from the pressure portion of the ejector to the outlet end of the ejector.

3. A dredging apparatus as set forth in claim 1, wherein the drive motor includes one of an electrical motor and a hydraulic motor.

4. A dredging apparatus as set forth in claim 1, wherein the drive motor is supplied with energy through a cable extending to a surface of one of a drilling platform and a ship.

5. A dredging apparatus, comprising:

a pumping device driven by a motor, the pumping device having water intake openings and having a pressure end;

a pipe bend coupled at a first end to the pressure end of the pumping device, the pipe bend having a second end that corresponds to a narrowing outlet end opening for passing water therethrough;

an ejector having a first end in which the second end of the pipe bend is disposed in a center portion of said ejector, and a second end that connects to an outlet pipe of the dredging apparatus, wherein said narrowing outlet end opening of said ejector maintains a water jet pointed in the direction of said outlet pipe; and a suction hose coupled to the second end of the ejector for passing dredging material to the ejector, said suction hose connected to said ejector upstream of said water jet and having an inlet portion for sucking in material on the seabed and transferring said material to said center portion of said ejector upstream of said water jet, and wherein said suction hose, said ejector and said outlet pipe form a substantially continuous bore.

6. The dredging apparatus according to claim 5, wherein the ejector has a gradually increasing pipe diameter in a direction from a middle portion of the ejector to the second end of the ejector.

* * * * *